United States Patent [19]

Griste

[11] 4,296,819

[45] Oct. 27, 1981

[54] CABLE TENSIONER FOR A DOWNCROWDING DEVICE FOR EARTH BORING MACHINES

[75] Inventor: Charles R. Griste, Corsicana, Tex.

[73] Assignee: Hughes Tool Company, Houston, Tex.

[21] Appl. No.: 147,999

[22] Filed: May 12, 1980

[51] Int. Cl.[3] ..... B23Q 5/027; B23Q 5/033

[52] U.S. Cl. ..... 173/147; 173/160; 254/284

[58] Field of Search ..... 173/147, 160; 254/284

[56] References Cited

U.S. PATENT DOCUMENTS 4,137,974 2/1979 Decker ..... 173/147

4,150,727 4/1979 Shepherd ..... 173/147

*Primary Examiner*—Ronald Feldbaum

*Attorney, Agent, or Firm*—Robert A. Felsman

[57] ABSTRACT

A downcrowding device for an earth boring apparatus has an improved take-up device for taking up slack in the downcrowding cable. The downcrowding device is of the type having a rotatable drum, hydraulic rams for moving the drum downwardly, a brake for preventing rotation of the drum while moving downwardly, and a downcrowding cable that is connected directly to the top of the kelly and wrapped around the drum. The take-up device includes a take-up sheave that is suspended from the mast. A take-up cable is wrapped around the drum for rotating the drum in the opposite direction to the downcrowding cable. The take-up cable is reeved over the take-up sheave and is connected to the top of the kelly. The cable tensioner is located between the mast and the take-up sheave for allowing the sheave to move downwardly with respect to the mast as the kelly and drum move downwardly during drilling. The cable tensioner draws the take-up sheave upwardly with respect to the mast to rotate the drum and take up slack as the drum is moved upwardly with the brake released. The displacement of the cable tensioner is equal to the displacement of the kelly or the drum.

2 Claims, 6 Drawing Figures

CABLE TENSIONER FOR A DOWNCROWDING DEVICE FOR EARTH BORING MACHINES

BACKGROUND OF THE INVENTION

1. Field of the Invention

This invention relates in general to earth boring machines, and in particular to a cable tensioner for a downcrowding device for use with earth boring machines.

2. Description of the Prior Art

In U.S. Pat. No. 4,150,727, a device is shown for applying downcrowding force on a cutting tool. The device includes a drum with a brake, hydraulic rams to move the drum vertically, and a downcrowding cable extending directly from the drum to the kelly. To apply downward force to the kelly, the brake is set and the drum is moved downwardly with the hydraulic rams to pull downwardly on the downcrowding cable and kelly.

When moving the drum upwardly with respect to the kelly to start a new stroke, a take-up cable is used to take up slack in the downcrowding cable. The take-up cable is wrapped around the drum, reeved over a sheave in the boom, and is connected to a spring cable tensioner at the top of the kelly. When the kelly and drum move downwardly, the length of the cable tensioner increases. When the brake is released on the drum and the drum is moved upwardly for a new stroke, the cable tensioner retracts, rotating the drum and taking up slack. The take-up cable thus increases in length, and the downcrowding cable decreases in length.

During downcrowding, the cable tensioner's length is increased equal to the kelly displacement plus the drum's displacement. Consequently, the cable tensioner must be able to expand and retract a distance twice that of the kelly displacement. While this take-up system is satisfactory, reducing the expansion and retraction distance of the cable tensioner would be advantageous.

SUMMARY OF THE INVENTION

It is accordingly a general object of this invention to provide an improved take-up device for a downcrowding system for an earth boring machine.

It is a further object of this invention to provide an improved take-up device for an earth boring machine in which the take-up cable tensioner has a required displacement equal to that of the downcrowding drum.

In accordance with these objects, a downcrowding device is used of the type having a rotatable drum, hydraulic rams for moving the drum downwardly, a brake for preventing rotation of the drum, and a downcrowding cable connected directly to the top of the kelly and wrapped around the drum. A take-up sheave is suspended from the mast or boom by a cable tensioning device. The cable tensioning device allows the sheave to move vertically with respect to the mast. The take-up cable is wrapped around the drum, extends over the take-up sheave, and is connected to the top of the kelly.

During downward movement of the drum and kelly, the take-up sheave moves downwardly with respect to the mast a distance equal to the kelly or drum displacement. The take-up sheave does not rotate during the downward movement. During the upward movement, the take-up sheave moves toward the mast a distance equal to the drum displacement, rotating the drum to take up slack in the downcrowding cable. By having the take-up sheave move in unison with the kelly as the kelly moves downwardly, the cable tensioner is required only to expand and retract a distance equal to the displacement of the kelly.

DESCRIPTION OF THE PREFERRED EMBODIMENT

Figure 1:
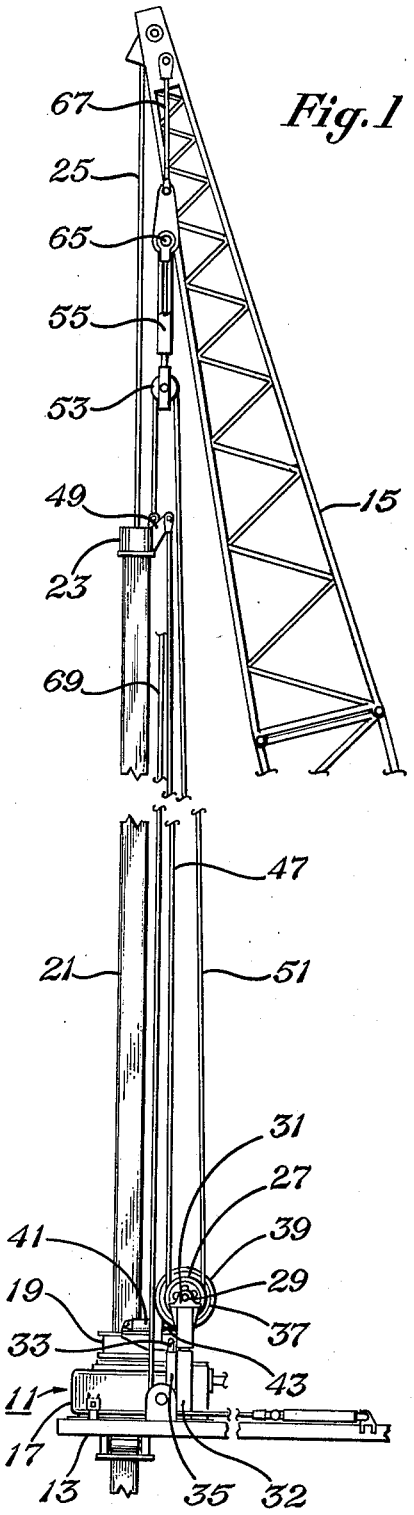
FIG. 1 is a side view of a downcrowding device constructed in accordance with this invention.

Referring to FIG. 1, an auger drilling machine mounted to a crane is shown. The auger drilling machine 11 comprises a drilling platform 13 connected by a structure (not shown) to the base of the mast or boom 15 of the crane. A rotary table 17 and its power unit (not shown) are carried on platform 13. The rotary table 17 supports a kelly bushing 19 that is rotated by the power unit.

A kelly 21 is adapted to extend slidingly into a square aperture 22 (FIG. 2) in kelly bushing 19. Kelly 21 comprises a length of pipe with four flat sides that mate with the sides of the kelly bushing 19 for rotation therewith. Kelly 21 includes a kelly head 23 at its top that allows rotation of kelly 21. A cable 25 from the crane winch (not shown) is reeved over a sheave 26 (FIGS. 4–6) at the end of boom 15 and connected to kelly head 23 for hoisting kelly 21. An auger (not shown) is connected to the bottom of kelly 21, or to intermediate joints of pipe at the bottom of kelly 21, to serve as a cutting tool for penetrating the earth. Consequently, the kelly 21 serves as a drive member, and the rotary table 17 and power unit serve as means for rotating it.

Downcrowding means for exerting a downward force on the kelly 21 includes a rotatable drum 27 carried by platform 13. The term "down" refers to the direction in which the hole is being drilled, although on some units and under certain circumstances, the drilled hole may not be vertical. Drum 27 is mounted rotatably on a axle 29 and is not power driven. Axle 29 is carried in a frame 31 that is reciprocally carried by platform 13 through telescoping members 32 on each side of the platform 13. Frame 31 is also connected on each side to the piston shaft 33 of a hydraulic ram or cylinder 35. The two hydraulic cylinders 35 are mounted parallel with kelly 21 and serve to move drum 27 in a line parallel with kelly 21. The telescoping members 32 add strength and stability.

A smooth cylindrical surface 37 on one side of drum 27 cooperates with a mating brake band 39 and a hydraulic cylinder 41 to serve as a braking means for selectively preventing rotation of drum 27. Hydraulic cylinder 41 is mounted perpendicular to the hydraulic cylinders 35, and has its piston shaft 43 connected to one end of brake band 39. The other end of brake band 39 is connected to frame 31. Retraction of hydraulic cylinder 41 creates a frictional force between band 39 and drum 27, preventing the rotation of drum 27.

Figure 2:
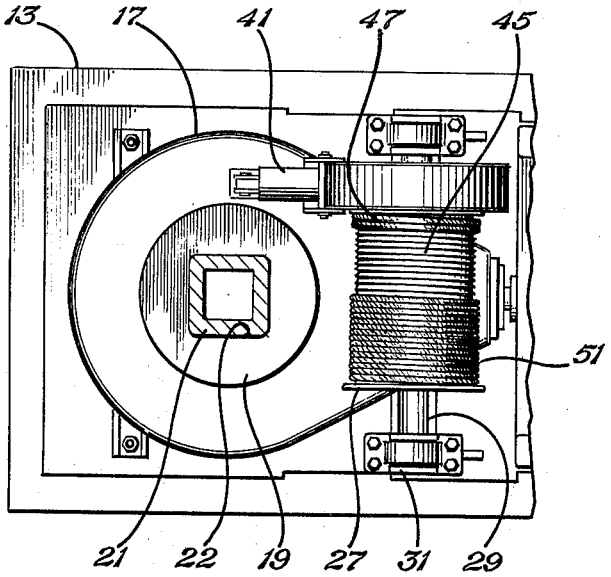
FIG. 2 is a cross sectional view of the downcrowding device of FIG. 1, taken along the line II—II of FIG. 1.

Referring also to FIG. 2, drum 27 has a plurality of circumferential grooves 45 for reeving cable. A downcrowding cable 47 is wrapped in a single layer around one side of drum 27. Downcrowding cable 47 extends directly to an arm 49 that forms a part of kelly head 23. Drum 27 is positioned close enough to kelly 21 so as to transmit substantially all of the downcrowding force in the downward direction.

Figure 3:
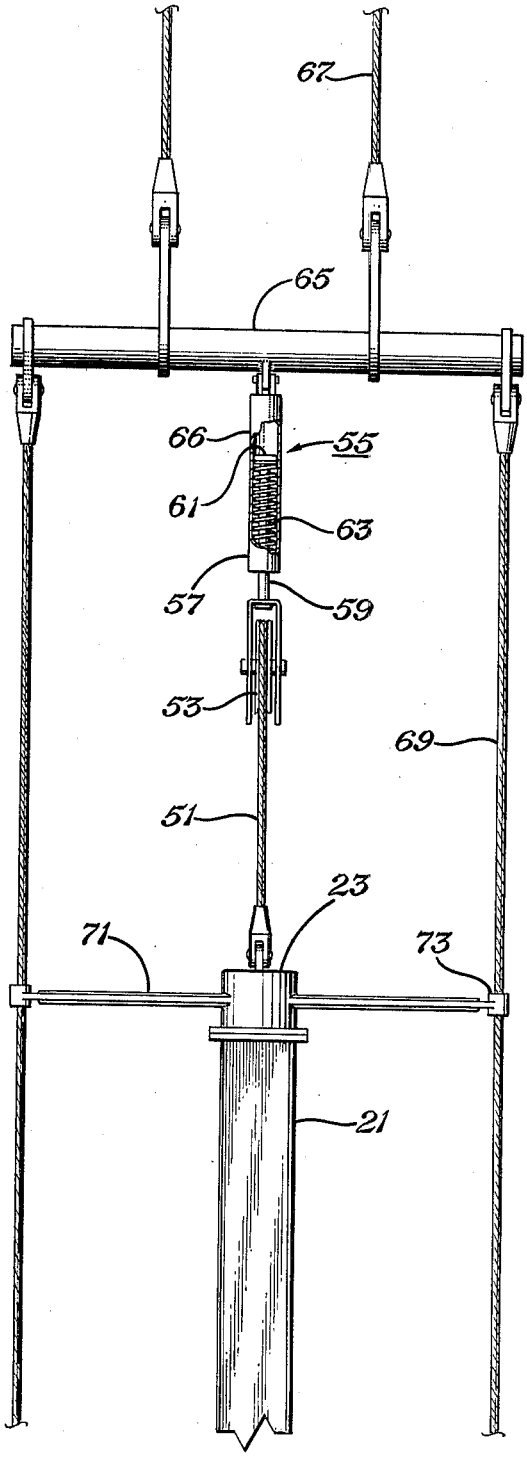
FIG. 3 is a front view of the cable tensioner portion of the downcrowding device of FIG. 1.

A take-up cable 51 is wrapped in a single layer around the drum 27 on the other end from the downcrowding cable 47. Cables 47 and 51 must extend from opposite sides of drum 27 so that pulling one cable will cause drum 27 to rotate and take up an equal amount from the other cable. Take-up cable 51 is reeved over a take-up sheave 53 carried by boom 15, and attached to kelly head 23, as shown in FIGS. 1 and 3. The length of cables 47, 51 and size of drum 27 are selected so that one cable will not overlap the other regardless of the position of kelly 21.

Referring to FIG. 3, take-up sheave 53 is suspended from a spring means or cable tensioner 55. The cable tensioner 55 allows the distance between the take-up sheave 53 and the boom 15 to change, and also urges the take-up cable 51 to rotate drum 27 to take up slack when brake 39 is released. The cable tensioner 55 comprises a cylindrical tube 57 that contains a telescoping rod 59. Rod 59 is secured to the take-up sheave 53 and is inserted in an aperture in the bottom of tube 57. The upper end of rod 59 has an annular flange or shoulder 61. The aperture in the bottom of tube 57 also has a shoulder (not shown). A helical coiled spring 63 is compressed between the shoulder 61 and the shoulder at the bottom of tube 57 for urging rod 59 upward.

The top of tube 57 is connected to a horizontal suspension bracket 65. Suspension bracket 65 is suspended from the top of boom 15 by two fixed-length cables 67. On each end of the suspension bracket 65, a cable 69 of fixed length extends directly to the platform 13. The kelly head 23 has two outrigger arms 71 rigidly secured to it and extending laterally outward parallel with the suspension bracket 65. Each outrigger arm 71 has a socket 73 through which one of the cables 69 slidingly extends. The outrigger arms 71 prevent the kelly head 23 from rotating with the kelly 21.

Figure 4:
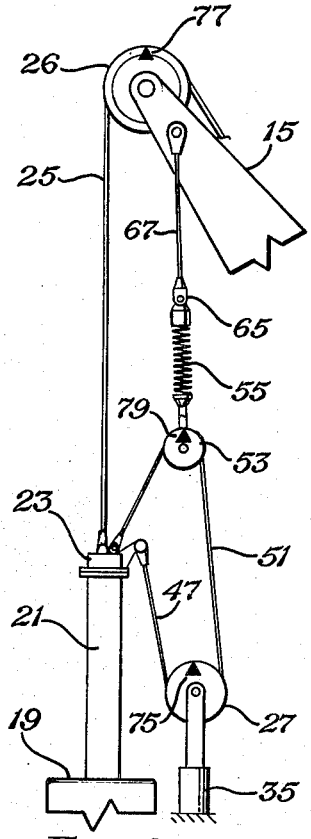
FIG. 4 is a schematic side view of the downcrowding device of FIG. 1, with the drum in the upper position.

The hydraulic circuitry for the downcrowding system is the same as that shown in U.S. Pat. No. 4,150,727, all of which material is hereby incorporated by reference. The operation of the downcrowding system may be best explained by referring to FIGS. 4–6. The downcrowding system is initially rigged up with downcrowning cable 47 and take-up cable 51 taut. Cable tensioner 55 will be set up initially with some tension pre-load. The position of boom 15 with respect to platform 13 will remain constant during drilling. Kelly 21 should be hoisted by cable 25 and the crane winch to an initial position with kelly head 23 a considerable distance above the kelly bushing 19. Drum 27 should be in the upper position, with the hydraulic cylinder 35 extended the maximum distance. This position is indicated in FIG. 4.

Figure 5:
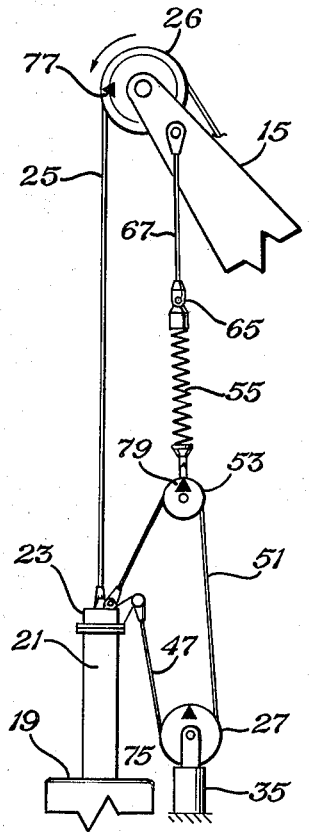
FIG. 5 is a schematic side view of the downcrowding device of FIG. 1, with the drum in the lower position.
Figure 6:
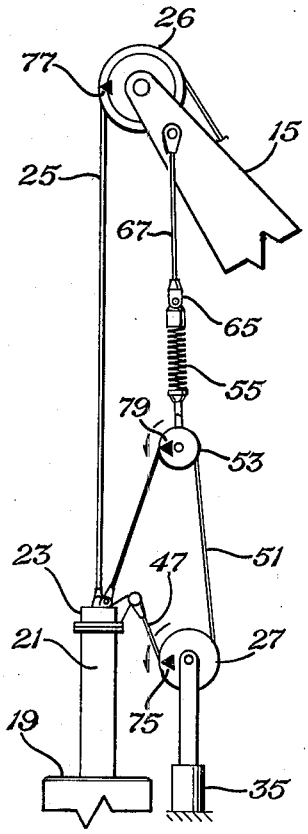
FIG. 6 is a schematic view of the downcrowding device of FIG. 1, with the drum shifted back to the upper position.

As the rotary table 17 rotates kelly 21, its cutting tool (not shown) begins advancing into the earth. To assist the advancement, the downcrowding system is employed. Hydraulic fluid pressure is supplied to the brake cylinder 41 (see FIG. 1) to apply brake band 39 to prevent rotation of drum 27. Then hydraulic fluid pressure is applied to the hydraulic cylinders 35 to urge the drum 27 downwardly toward platform 13. The kelly 21 and hydraulic cylinders 35 will travel downward until they reach the end of the displacement or stroke, as shown in FIGS. 1 and 5, which may be approximately one foot or more. As shown by the indicating symbol 75 in FIGS. 4 and 5, drum 27 will not have rotated during the downstroke. Boom sheave 26 will have rotated because of the linear downward movement of drum 27, as indicated by symbol 77. Take-up sheave 53 will have moved downward the same linear distance the drum 27 moved, thus increasing the length of the cable tensioner 55 by this amount. In FIGS. 4–6, cable tensioner 55 is shown symbolically to be in increased tension in FIG. 5. Actually, the spring 63 (FIG. 3) within cable tensioner 55 compresses as the drum 27 moves downward with respect to the cable tensioner. Spring 63 (FIG. 3) will compress and store energy. The take-up sheave 53 will not have rotated, as indicated by symbol 79. Consequently, the lengths of the downcrowding cable 47 and take-up cable 51 will be the same in FIG. 5 as in FIG. 4.

In order to continue downcrowding, after a full stroke of the hydraulic cylinders 35 the operator must return the drum 27 to the upper position shown in FIG. 6. Drilling rotation while moving the drum 27 upward may continue if desired. At the beginning of its upward movement and during its upward movement, the brake hydraulic cylinder 41 is reversed, causing the brake band 39 to release from brake surface 37. Hydraulic fluid pressure is supplied to the hydraulic cylinders 35 to move the drum 27 upward. As the drum 27 moves upward, the cable tensioner 55 will draw the take-up sheave 53 upward back to its original position, as shown in FIG. 4. Since the brake band 39 is loosened, the energy stored in spring 63 of the cable tensioner 55 will cause the take-up sheave 53 and drum 27 to rotate, as shown by their indicating symbols 75 and 79. The cable tensioner 55 will return to the length that it had at the beginning of the stroke, shown in FIG. 4. Slack will be taken up in the downcrowding cable 47, and the take-up cable 51 will be lengthened correspondingly.

The cycle may then be repeated until the kelly head 23 nears the same level as drum 27. Then the kelly 21 may be drawn up by cable 25. The brake 39 should be released allowing drum 27 to rotate to decrease the length of the take-up cable 51 and increase the length of the downcrowding cable 47 by the same amount.

An invention having significant advantages has been provided. By utilizing a take-up sheave, the cable tensioner of the take-up cable is required only to extend a length equal to the amount the drum moves downwardly. This reduces by half the amount of extension required in the prior art. This lesser displacement allows a shorter cable tensioner. Additionally, the invention does not require the cable tensioner to be awkwardly mounted on the kelly head.

While the invention has been shown in only one of its forms, it should be apparent to those skilled in the art that it is not so limited but is susceptible to various changes and modifications without departing from the spirit thereof.

I claim:

1. In an earth boring apparatus having a kelly suspended by a mast, a downcrowding device having a rotatable drum, hydraulic ram means for moving the drum downwardly, brake means for preventing rotation of the drum, and a downcrowding cable connected directly to the top of the kelly and wrapped around the drum, an improved take-up means for removing slack in the downcrowding cable when raising the drum, comprising in combination:

a take-up sheave carried below the mast;

a take-up cable wrapped around the drum and extending from the drum on a side opposite to the side that the downcrowding cable extends from, the take-up cable being reeved over the take-up sheave and connected to the top of the kelly; and cable tensioner means connected between the take-up sheave and the mast for allowing the take-up sheave to move downwardly with respect to the mast as the kelly and drum move downwardly during drilling, and for urging the take-up sheave upwardly with respect to the mast to rotate the drum and take up slack as the drum is moved upwardly with the brake being released.

2. In a crane mounted earth boring apparatus having a rotary drive carried by a platform attached to the crane, a kelly suspended from a boom and extending reciprocally through a rotary drive for rotation therewith, a downcrowding means for exerting a downward force on the kelly that includes a rotatable drum with a brake, a hydraulic cylinder for moving the drum downwardly, and a downcrowding cable wrapped around the drum and extending directly to the top of the kelly, an improved take-up means for removing slack in the downcrowding cable when raising the drum, comprising in combination:

a take-up sheave carried below the boom;

a take-up cable wrapped around the drum and extending from a side of the drum opposite to the side that the downcrowding cable extends from, so that pulling one cable draws the other inward, the take-up cable being reeved over the take-up sheave and having an end connected to the top of the kelly; and cable tensioner means connected between the take-up sheave and the boom for allowing the take-up sheave to move downwardly with respect to the boom as the kelly and drum move downwardly during drilling and for storing energy during downward movement, then for releasing the stored energy to draw the take-up sheave upwardly with respect to the mast to rotate the drum and take up slack as the drum is moved upwardly with the brake released.

* * * * *